US007459422B2

(12) United States Patent
Mort, III et al.

(10) Patent No.: US 7,459,422 B2
(45) Date of Patent: Dec. 2, 2008

(54) PROCESS FOR MAKING A GRANULAR DETERGENT COMPOSITION HAVING IMPROVED SOLUBILITY

(75) Inventors: Paul R Mort, III, Cincinnati, OH (US); Stewart Curtis Doty, Okeana, OH (US); Girish Jagannath, Mason, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 470 days.

(21) Appl. No.: 11/201,524

(22) Filed: Aug. 11, 2005

(65) Prior Publication Data

US 2006/0035803 A1 Feb. 16, 2006

Related U.S. Application Data

(60) Provisional application No. 60/600,463, filed on Aug. 11, 2004.

(51) Int. Cl.

| | |
|---|---|
| ***C11D 11/02*** | (2006.01) |
| ***C11D 17/06*** | (2006.01) |
| ***C11D 3/37*** | (2006.01) |
| ***C11D 3/08*** | (2006.01) |
| ***C11D 3/10*** | (2006.01) |

(52) U.S. Cl. ..... 510/443; 510/452; 510/444; 510/361; 510/477; 510/478; 510/509; 510/511

(58) Field of Classification Search ..... 510/361, 510/475, 477, 478, 509, 511, 443, 452, 444
See application file for complete search history.

(56) References Cited

U.S. PATENT DOCUMENTS

| | | | | |
|---|---|---|---|---|
| 4,434,067 | A * | 2/1984 | Malone et al. | 510/278 |
| 4,725,455 | A * | 2/1988 | Taha | 510/443 |
| 4,747,880 | A * | 5/1988 | Berrido et al. | 106/205.8 |
| 5,668,099 | A | 9/1997 | Chapman et al. | |
| 5,814,597 | A | 9/1998 | Raehse et al. | |
| 6,586,386 | B2 * | 7/2003 | Srinivas et al. | 510/446 |
| 6,864,221 | B1 * | 3/2005 | Takana et al. | 510/438 |
| 6,894,019 | B2 * | 5/2005 | Oki et al. | 510/507 |
| 2003/0004086 | A1 * | 1/2003 | Takana et al. | 510/445 |

FOREIGN PATENT DOCUMENTS

| | | | |
|---|---|---|---|
| DE | 42 13 036 | A1 | 10/1993 |
| DE | 44 06 591 | A1 | 9/1995 |
| EP | 043 437 | A1 | 6/1991 |
| WO | WO 00/77148 | A1 * | 12/2000 |

* cited by examiner

*Primary Examiner*—Lorna M Douyon
(74) *Attorney, Agent, or Firm*—Ronald T. Sia; David V. Upite; Kim W. Zerby

(57) ABSTRACT

The present invention relates to a substrate composition comprising from about 20 wt % to about 60 wt % of a water-soluble and/or water-dispersible polymer and from about 20 wt % to about 80 wt % of a water-soluble inorganic salt. The substrate composition of the present invention has a median particle size of from about 1 micrometer to about 100 micrometers and comprises less than about 10 wt % of water-insoluble material.

12 Claims, No Drawings

PROCESS FOR MAKING A GRANULAR DETERGENT COMPOSITION HAVING IMPROVED SOLUBILITY

CROSS REFERENCE TO RELATED APPLICATIONS

This application claims priority to U.S. Provisional Application Ser. No. 60/600,463, filed Aug. 11, 2004.

FIELD

The present invention relates to a process for making a granular detergent composition. More particularly, the present invention relates to a process for making a granular detergent composition having improved solubility.

BACKGROUND

Over the past several years, the detergent market has shifted towards heavy-duty liquid (HDL) laundry detergents. Whilst much of this shift is driven by the pre-dissolved nature of the HDL detergent product, which eliminates the occasional occurrence of undissolved or partially-dissolved residues on fabrics associated with granular laundry detergents, HDL detergents offer the laundry detergent formulator more freedom and flexibility to use solution-based precursors in the formulation, especially water-soluble and/or water-dispersible polymers. The chemistries of said water-soluble and/or water-dispersible polymers have evolved over the past decade to deliver improved detergent performance, especially with regard to builder functionality and soil dispersion. In addition, there may be additional functionalities that can be specially developed for granular detergents using polymers: e.g. chelating heavy metals that can otherwise interfere with bleach chemistry. Based on this performance evolution, it has become increasingly desirable to include higher levels of water-soluble precursors in granular detergents.

Generally, there are two primary types of processes by which detergent granules or powders can be prepared. The first type of process involves spray-drying an aqueous detergent slurry in a spray-drying tower to produce highly porous detergent granules (e.g. a tower process for the production of low density detergent compositions). In the second type of process, the various detergent components are dry mixed after which they are agglomerated with a binder such as a nonionic or anionic surfactant, to produce high density detergent compositions (e.g. an agglomeration process for the production of high density detergent compositions).

Additionally, extrusion processes have been used to make detergent particles using a combination of dry powder and liquid binder components, similar to agglomeration processes.

In the above processes, the important factors which govern the density of the resulting detergent granules are the shape, porosity and particle size distribution of said granules, the density of the various detergent adjunct ingredients, the shape of the various detergent adjunct ingredients, and their respective chemical composition. Of the above processes, it is considered that spray-drying is well suited to handling large formula fractions of solution-based precursors.

However, there are several issues with spray-drying that render it unsuitable to produce the desired end products. Also, there is still a need to improve the solubility of granular detergent products. Thus, there is still a need for developing a process for making detergent granules, which is suitable to produce the desired end products.

SUMMARY

The present invention relates to a substrate composition comprising from about 20 wt % to about 60 wt % of a water-soluble and/or water-dispersible polymer and from about 20 wt % to about 80 wt % of a water-soluble inorganic salt. The substrate composition has a median particle size of from about 1 micrometer to about 100 micrometers and contains less than about 10 wt % of water-insoluble material.

In accordance with one embodiment of the present invention, a process is provided to form a granular detergent composition with improved solubility. The process comprises the steps of: mixing the polymer and the salt to obtain a mixture in the form of a slurry; spray-drying the slurry mixture to obtain a dry granular power; and milling the dry granular power to form a substrate composition having a median particle size in the range from about 1 micrometer to about 50 micrometers.

As stated above, there is a need to include higher levels of water-soluble precursors that are typically in the form of solution precursors, in granular detergents. The challenge is to convert the solution precursor into a dry granular form that: (a) is physically stable (i.e. it does not absorb excessive moisture from the atmosphere, leading to physical and/or chemical instability of the product); (b) is readily re-dispersible and dissolves quickly in the wash; (c) can meet regional market requirements for high-density compact detergents (e.g. in Japan); and (d) achieves the above objectives using an economical source of the raw materials and an economical process.

Spray-drying is one typical process for making low-density detergents, or even medium-density detergents. However, there are several issues with spray-drying that render it unsuitable to produce the desired end product. Blown-granules are typically too low in bulk density to meet many market needs. Also, spray-drying a composite formulation with high levels of solution-based precursors and high levels of surfactants can pose difficulties in processing: e.g. sticky product can attach to the walls of the spray-drying tower and lead to product quality issues. In addition, spray-dried granules with such high levels of organic materials are typically prone to a poor physical stability profile and a poor handling profile.

The present invention provides a substrate composition typically comprised of fine particles of a composite composition, of which at least one component of the composite composition is derived from a solution-based precursor. As the substrate composition is typically in the form of a fine dry powder, it is suitable as a feedstock powder in agglomeration or extrusion processes.

As a result, the present invention enables an efficient way to add high levels of solution-based precursors, especially water-soluble and/or water-dispersible polymers, to a dry granular detergent formulation. Also, the present invention provides a substrate powder suitable for use in a subsequent process to make a granular detergent product, such as an agglomeration process. The substrate is typically derived from an intermediate blown powder, wherein a spray-drying process is used to dry the solution precursors. Spray-drying is typically the most cost-efficient way to dry large moisture loads from a solution-mixture or slurry-mixture of precursors.

In the case where larger particles (i.e. particles having a median particle size of 100 micrometers or larger) are formed in the spray drying process, then a dry milling process step may be used to reduce the substrate composition particle size to a finer particle size range (i.e. particles having a median particle size of from 1 to 50 micrometers or smaller).

Finally, since the substrate composition comprises a substantially high percentage of water-soluble ingredients, detergent compositions comprising the substrate composition of the present invention exhibit improved solubility profiles. In addition, the surface chemistry of the substrate composition, when in particulate form, is observed to be higher in concentration of the water-soluble and/or water-dispersible polymer relative to the remainder of the substrate composition. It is further observed that the relative increase in the polymer concentration at the surface of the substrate composition offers further advantages for improved dissolution performance of granules made with the substrate.

In a preferred embodiment of the present invention, the substrate composition is in particulate form and comprises an outer region and an inner region, when the distribution of the polymer within the substrate composition is such that the outer region of the substrate composition comprises a higher concentration of water-soluble and/or water-dispersible polymer relative to the concentration of water-soluble and/or water-dispersible polymer in the inner region.

DETAILED DESCRIPTION

Definitions

All percentages, ratios, and levels of ingredients referred to herein are weight based on the total amount of the substrate composition, unless otherwise indicated. All measurements referred to herein are made at 25° C., unless otherwise specified. As used herein, the term "comprising" and its derivative terms are intended to be open-ended terms that specify the presence of the stated features, elements, components, groups, integers, and/or steps, but do not exclude the presence of other, unstated features, elements, components, groups, integers, and/or steps. This definition also applies to words of similar meaning, for example, the term "have", "include", "be provided with" and their derivative terms. This term encompasses the terms "consisting of" and "consisting essentially only of".

Substrate Composition

The substrate composition of the present invention comprises from about 20 wt % to about 60 wt %, preferably, from about 30 wt % to about 50 wt %, or from about 30 wt % to about 40 wt %, or from about above 40 wt % to about 50 wt % of a water-soluble and/or water-dispersible polymer and from about 20 wt % to about 80 wt %, preferably, from about 40 wt % to about 70 wt %, or from about 40 wt % to about 50 wt %, or from about 55 wt % to about 65 wt % of a water-soluble inorganic salt. Also, the substrate composition of the present invention has a median particle size of from about 1 micrometer to about 100 micrometers, or from about 1 micrometer to about 50 micrometers. In addition, the substrate composition of the present invention contains less than about 10% by weight of water-insoluble material. The water-solubility of the substrate composition is determined by the method described in more detail below.

The physical form of the substrate composition may be such that a core of a water-soluble inorganic salt is at least partially, or even substantially, enclosed, encapsulated and/or coated with a water-soluble and/or water-dispersible polymer. Without being bound by theory, the distribution of the water-soluble and/or water-dispersible polymer on the surface of a core of water-soluble inorganic salt is believed to improve the dissolution performance of the detergent product and results in a significant reduction of on-fabric residue.

The median particle size of the substrate composition is typically determined by the method described in more detail below.

Method for Determining the Water-Solubility of the Substrate Composition

The water-solubility of the substrate composition is typically determined by the following method:

1. Weight 3.5 g of substrate composition and dose it into an 8 oz. bottle.
2. Add 150 ml water to the bottle, cap and place in a 70° C. water bath for 3 hours.
3. Remove the bottle from the water-bath and place on a mechanical shaker and shake vigorously for 1 hour.
4. Filter the sample through a pre-weighed sheet of tared filter paper using a filter holder assembly (such as a Model XX1004700 filter holder assembly supplied by Millipore Corporation, Bellerica, Mass., USA) and a cellulose membrane filter having a pore size of 0.45 micrometers (such as a HAWP04700 filter supplied by Millipore Corporation, Bellerica, Mass., USA). The bottles are rinsed several times with water to ensure the removal of the sample from the bottle, and the rinse water is also poured through the filter.
5. Once the sample has drained through the filter paper. The filter paper is folded to avoid loosing the solid material collected on the filter paper. The filter paper is placed in a tared 150 ml beaker and dried overnight at 100° C.
6. The filter paper is then placed in a dessicator to dry and cool to room temperature (25° C.) until constant weight is obtained, and is then weighed. The weight of the solid material on the filter paper is then determined according to the gross weight of the filter paper containing any residue minus the initial tare weight of the filter paper.
7. The percentage of insoluble material is calculated as follows: wt % insoluble material=100×(weight (in grams) of solid material on the filter paper after step 6/weight (in grams) of sample dosed in step 1 (3.5g))

Typically, the substrate composition leaves less than 10%, by weight of the amount originally dosed into the beaker in step 1, of solid material on the filter paper after step 6.

Method for Determining the Median Particle Size of the Substrate Composition The median particle size of the substrate composition is typically determined in accordance with ISO 8130-13, "Coating powders—Part 13: Particle size analysis by laser diffraction." A suitable laser diffraction particle size analyzer with a dry-powder feeder can be obtained from Horiba Instruments Incorporated of Irvine, Calif., U.S.A.; Malvern Instruments Ltd of Worcestershire, UK; and Beckman-Coulter Incorporated of Fullerton, Calif., U.S.A.

The results are expressed in accordance with ISO 9276-1: 1998, "Representation of results of particle size analysis—Part 1: Graphical Representation", FIG. A.4, "Cumulative distribution $Q_3$ plotted on graph paper with a logarithmic abscissa." The median particle size is defined as the abscissa value at the point where the cumulative distribution ($Q_3$) is equal to 50 percent.

Water-Soluble and/or Water-Dispersible Polymer

The substrate composition of the present invention comprises from about 20 wt % to about 60 wt %, preferably, from about 30 wt % to about 50 wt %, or from about 30 wt % to about 40 wt %, or from about greater than 40 wt % to about 50 wt % of a water-soluble and/or water-dispersible polymer. The water-soluble and/or water-dispersible polymer is preferably a polymeric polycarboxylic acid, more preferably selected from the group consisting of polyacrylic acid polymer, polymaleic acid polymer, polyacrylic-maleic co-polymer and mixtures thereof. The water-soluble and/or water-dispersible polymer of the present invention also includes their salts, preferably alkaline salts such as sodium polyacrylate, sodium polymaleate, etc. The water-soluble and/or water-dispersible polymer typically has a molecular weight of from 2,000 Da to 100,000 Da, or preferably from 3,000 Da to 5,000 Da, or from 10,000 Da to 15,000 Da, or even from 50,000 Da to 90,000 Da. The water-solubility or water-dispersibility of the polymer is typically determined by the method described in more detail below.

Method for Determining the Water-Solubility or Water-Dispersibility of the Polymer The water-solubility or water-dispersibility of the polymer is typically determined by the following method:

1. Weight 3.5 g of the water-soluble and/or water-dispersible polymer and dose it into an 8 oz. bottle.
2. Add 150 ml water to the bottle, cap and place in a 70° C. water bath for 3 hours.
3. Remove the bottle from the water-bath and place on a mechanical shaker and shake vigorously for 1 hour.
4. Filter the samples through a pre-weighed sheet of tared filter paper using a filter holder assembly (such as a Model XX1004700 supplied by Millipore Corporation, Bellerica, Mass., USA) and a cellulose membrane filter having a pore size of 0.45 micrometers (such as a HAWP04700 filter supplied by Millipore Corporation, Bellerica, Mass., USA)). The bottles are rinsed several times with water to ensure the removal of the sample from the bottle, and the rinse water is also poured through the filter.
5. Once all of the samples have drained through the filter paper. The filter paper is folded to avoid loosing the solid material collected on the filter paper. The filter paper is placed in a tared 150 ml beaker and dried overnight at 100° C.
6. The filter paper is then placed in a dessicator to dry and cool to room temperature (25° C.) until constant weight is obtained, and is then weighed. The weight of the solid material left on the filter paper is determined according to the gross weight of the dried filter containing any residue minus the initial tare weight of the filter.
7. The percentage of insoluble material is calculated as follows: wt % insoluble material=100×(weight (in grams) of solid material on the filter paper after step 6/weight (in grams) of sample dosed in step 1 (3.5 g))

Typically, the water-soluble and/or water-dispersible polymer leaves no more than 0.5%, by weight of the amount originally dosed into the beaker in step 1, of solid material on the filter paper after step 6.

Water-Soluble Inorganic Salt

The substrate composition of the present invention comprises from about 20 wt % to about 80 wt % preferably, from about 40 wt % to about 70 wt %, or from about 40 wt % to about 50 wt %, or from about 55 wt % to about 65 wt % by weight of a water-soluble inorganic salt. The water-soluble inorganic salt is preferably selected from the group consisting of a sulfate, a carbonate, a silicate and mixtures thereof. The preferred silicate is sodium silicate and more preferably, the sodium silicate has a molar ratio of $SiO_2$ to $Na_2O$ of from about 1.0 to about 3.2, preferably, from about 1.4 to about 2.2, more preferably, from about 1.6 to about 2.0.

Weight Average Particle Size

The substrate composition of the present invention has a median particle size of from about 1 micrometer to about 100 micrometers, preferably, from about 1 micrometer to about 50 micrometers, more preferably, from about 1 micrometer to about 25 micrometers. The median particle size is measured by using laser diffraction with dry powder feeder.

Water-Insoluble Material

The substrate composition of the present invention comprises less than about 10 wt %, preferably, less than about 5 wt %, more preferably, less than about 1 wt % of water-insoluble material. Typical water-insoluble material is zeolite and the substrate composition of the present invention is preferably substantially free from zeolite.

First Surfactant

The substrate composition of the present invention optionally, but preferably, comprises from about 1 wt % to about 20 wt %, preferably, from about 1 wt % to about 10 wt %, or from 1 wt % to 5 wt %, or even from 2 wt % to 4 wt % of a first surfactant. The preferred first surfactant is selected from the group consisting of anionic surfactant, nonionic surfactant, cationic surfactant, amphoteric surfactant and a mixture thereof. The more preferred first surfactant is selected from the group consisting of alkyl benzene sulphonate (LAS), alkyl sulfate (AS), alkyl ethoxy sulfate (AES) and a mixture thereof. Other surfactants that are suitable for use as the first surfactant are described in more detail in U.S. Pat. No. 6,391,839 to Addison, issued May 21, 2002.

Process for Making the Substrate Composition

The substrate composition of the present invention is prepared by a process comprising the steps of: (1) mixing the polymer and salt to obtain a mixture that is in the form of a slurry; (2) spray-drying the slurry mixture from step (1) to obtain a dry granular powder; and (3) milling the dry granular powder from step (2) to produce a substrate composition having a median particle size in the range from about 1 micrometer to about 50 micrometers.

Step (1) Obtaining a Slurry Mixture

This step involves the mixing of the water-soluble and/or water-dispersible polymer and the water-soluble inorganic salt to form a mixture that is in the form of a slurry. The slurry mixture typically comprises a continuous solution phase comprising the polymer, and a discontinuous phase comprising the salt. Optionally, surfactant may be added to the polymer and salt in this step and form part of the slurry mixture. Typically, a suitable slurry can be prepared by suspending the dry ingredients in the liquid ingredients, optionally with the addition of water. It may be preferred for no, or only a minimal amount of, water to be added in step (1); because the minimization of added water reduces the total drying load in the spray-drying step, which reduces the energy consumption of the process. Typically, the water-soluble inorganic salts are, at least in part, in the form of powder (i.e. being substantially in un-dissolved form) that is dispersed in the slurry.

Step (2). Spray-Drying the Slurry Mixture to Obtain a dry Granular Powder

This step involves spray-drying the slurry mixture obtained in step (1) to produce a dry granular powder. The slurry mixture is atomized to form atomized droplets, which are then dried in a spray-drying tower to form a dry granular powder, typically in free-flowing particulate form. In this step, typically a thin layer of the polymer is dried onto the surface of the salt so as to at least partially enclose, or even completely enclose, the salt material.

Step(3). Milling the Dry Granular Powder

This step involves the milling of the dry granular powder obtained in step (2) to produce a substrate composition having a median particle size in the range from about 1 micrometer to about 50 micrometers. Sufficient mechanical energy is required in this step to comminute the dry granular powder to a substrate composition. A suitable mill for milling the dry granular powder includes high speed pin mills, counter-rotating pin mills, hammer mills, air-classifier mills and jet mills. A preferred mill is a high speed pin mill, for example, Netsch CUM, provided by Hosokawa Alpine.

In another embodiment of the present invention, it is possible to mill the slurry mixture obtained in step (1) to provide a finely-dispersed mixture, then spray-drying the finely-dispersed mixture using a finely-atomizing nozzle to directly form a substrate composition having a median particle size in the range from about 1 micrometer to about 50 micrometers. In this embodiment, a suitable mill includes a colloid mill, ball mill and a high speed rotor-stator mixer that are capable of comminuting and de-agglomerating the discontinuous phase of the slurry mixture. A suitable mill is an IKA mill supplied by IKA Werde GmbH, Staufen, Germany.

The finely-dispersed mixture can undergo a spray-drying step, which provides sufficient atomization of the finely-dispersed mixture to form finely-atomized droplets which are then dried directly to form a substrate composition having a median particle size in the range of from about 1 micrometer to about 50 micrometers. This spray-drying is conducted by using a finely-atomizing nozzle, such as a combustion nozzle.

Detergent Composition

The detergent composition of the present invention may comprise from about 10 wt % to about 60 wt % of the substrate composition. The detergent composition may further comprise a builder, an enzyme and other conventional ingredients.

Second Surfactant

The detergent composition of the present invention comprises from about 1 wt % to about 20 wt % of a second surfactant. The second surfactant can be the same or different from the first surfactant which can be added to the substrate composition. A preferred second surfactant is selected from the group consisting of anionic surfactant, nonionic surfactant, cationic surfactant, amphoteric surfactant and a mixture thereof. A more preferred second surfactant is selected from the group consisting of alkyl benzene sulfonate (LAS), alkyl sulfate (AS), alkyl ethoxy sulfate (AES) and mixtures thereof. Other surfactants that are suitable for use as the second surfactant are described in U.S. Pat. No. 6,391,839 to Addison, issued May 21, 2002.

It may be preferred for the first surfactant to be selected from the group consisting of AS, AES and mixtures thereof, and for the second surfactant to be LAS Other Ingredients The detergent composition of the present invention may further comprise a builder, an enzyme, a dye, a perfume or other conventional ingredients. Suitable other ingredients are described in U.S. Pat. No. 6,391,839 to Addison, issued May 21, 2002.

Process for Making the Detergent Composition

The detergent composition of the present invention may be prepared by a process comprising steps of: (1) mixing the polymer and salt to obtain a mixture in the form of a slurry; (2) spray-drying the slurry mixture to obtain a dry granular powder; (3) milling the dry granular powder to reduce its particle size so as to form a substrate composition having a median particle size in the range from about 1 micrometer to about 50 micrometers; and (4) agglomerating the substrate composition with a fluid binder to obtain a detergent granular composition.

Steps (1), (2) and (3) require the same process conditions, parameters and features that are described in more detail above for the process for preparing the substrate composition of the present invention Step (4) involves the agglomeration of the substrate composition from step (3) with a fluid binder to obtain a detergent granular composition. The agglomeration may be conducted using any suitable agglomeration equipment. Preferably agglomeration equipment is selected from the group consisting of high-shear mixer-agglomerators, medium shear mixer-agglomerators, low-shear fluid-bed agglomeration systems, and combinations thereof.

Fluid Binder

The fluid binder can be any suitable fluid to agglomerate the substrate composition. Preferably, the fluid binder comprises water, the second surfactant, acid precursors of the second surfactant, or mixtures thereof.

EXAMPLES

Example 1

Process for Making a Substrate Composition

Step 1 (Mixing)

A sodium $C_{10-13}$ linear alkyl benzene sulphonate (NaLAS) paste (50% aqueous solution), sodium polyacrylate solution (44% aqueous solution), sodium silicate 1.6R (47% aqueous solution) and sodium carbonate powder are dosed into a low-shear mixing vessel to form an aqueous slurry mixture.

Step 2 (Spray-Drying)

The slurry mixture is heated to 80° C. and is fed under high pressure, (6,000-7,000 kPa), into a conventional counter-current spray drying tower with an air inlet temperature of 300-310° C. The atomised slurry is dried to produce a dry granular powder.

Step 3 (Milling)

The dry granular powder is milled through a high speed pin mill (for example, Netsch CUM mill, with pin disc rotor, running at 15000 RPM with a feed rate of 300 kg/hr) to produce a substrate composition having a weight average particle size in the range of from 1 micrometer to 50 micrometer and comprising 4 wt % NaLAS, 35 wt % sodium polyacrylate, 14 wt % sodium silicate 1.6R, 43 wt % sodium carbonate and balance moisture.

Example 2

Substrate Compositions

The amounts of ingredients given below are in weight %.

| Ingredients | (A) | (B) | (C) | (D) | (E) | (F) | (G) |
|---|---|---|---|---|---|---|---|
| $C_{10-13}$ linear alkyl benzene sulphonate, sodium salt | 4.0 | 4.0 | 12.0 | 0.0 | 0.0 | 0.0 | 4.0 |
| C14-15 alkyl sulfate, sodium salt | 0.0 | 0.0 | 0.0 | 20.0 | 20.0 | 0.0 | 0.0 |
| Sodium polyacrylate polymer | 35.0 | 36.0 | 36.0 | 26.0 | 36.0 | 49.8 | 28.0 |
| Sodium silicate 1.6R | 14.0 | 0.0 | 0.0 | 10.4 | 0.0 | 0.0 | 20.0 |
| Sodium carbonate | 43.2 | 55.1 | 47.8 | 40.0 | 40.4 | 27.5 | 20.0 |

-continued

The amounts of ingredients given below are in weight %.

| Ingredients | (A) | (B) | (C) | (D) | (E) | (F) | (G) |
|---|---|---|---|---|---|---|---|
| Sodium sulfate | 0.0 | 0.0 | 0.0 | 0.0 | 0.0 | 20.0 | 25.7 |
| Moisture | 3.0 | 3.9 | 3.3 | 2.8 | 2.8 | 1.9 | 1.4 |
| Miscellaneous | 0.8 | 1.0 | 0.9 | 0.8 | 0.8 | 0.8 | 0.9 |
| Total | 100.0 | 100.0 | 100.0 | 100.0 | 100.0 | 100.0 | 100.0 |

Example 3

Process for Making a Granular Laundry Detergent Composition by Paste Agglomeration The substrate composition that is prepared according to example 1 is dosed into a high-sheer mixer (CB100 Loedige), optionally with other dry powders, for example zeolite A and/or sodium carbonate. A high active surfactant paste (e.g. 72 wt % active sodium linear alkyl benzene sulphonate, (NaLAS)) is dosed into the high-speed mixer and dispersed with the powders by the mixing elements to form a mixture. The mixture is dosed into a moderate-shear agglomerator (KM1500 Loedige). A secondary binder (e.g. water) is optionally sprayed into the moderate-shear agglomerator to build particle size, and the mixture is densified and agglomerated to form wet agglomerates. The wet agglomerates are sieved to removed oversized material (>2250 micrometers), and are dried in a fluid bed dryer. The resultant dry agglomerates are sieved to remove oversized material (>1180 micrometers) to produce a granular laundry detergent composition.

Example 4

Process for Making a Granular Laundry Detergent Composition by Dry Neutralization The substrate composition that is prepared according to example 1 is dosed into a high-sheer mixer (CB100 Loedige) together with sodium carbonate powder and, optionally zeolite powder. Linear alkyl benzene sulphonic acid (HLAS) is dosed as a liquid binder into the high-speed mixer and dispersed with the powders by the mixing elements to form a mixture. The mixture is dosed into a moderate-sheer agglomerator (KM1500 Loedige). A secondary binder (e.g. water) is optionally sprayed into the moderate-shear agglomerator to build particle size, and the mixture is densified and agglomerated to form wet agglomerates. The agglomerates are sieved to removed oversized material (>2250 micrometers), and are then optionally dried in a fluid bed dryer. The resultant dry agglomerates are sieved to remove oversized material (>1180 micrometers) to produce a granular laundry detergent composition.

Example 5

Process for Making a Granular Laundry Detergent Composition by Combined Dry Neutralization and Paste Agglomeration Take the substrate composition that is prepared according to example 1 is dosed into a high-sheer mixer (CB100 Loedige) together with sodium carbonate powder and, optionally zeolite powder. Linear alkyl benzene sulphonic acid (HLAS) is then dosed as a liquid binder into the high-speed mixer and dispersed with the powders by the mixing elements to form a mixture. The mixture is dosed into a moderate-sheer agglomerator (KM1500 Loedige). A high active surfactant paste binder, (72 wt % sodium alkyl sulfate aqueous paste), is added. Optionally, additional water is added to the moderate-shear agglomerator to build particle size, and the mixture is densified and agglomerated to form wet agglomerates. The agglomerates are sieved to removed oversized material (>2250 micrometers), and are then optionally dried in a fluid bed dryer. The resultant dry agglomerates are sieved to remove oversized material (>1180 micrometers) to produce a granular laundry detergent composition.

Example 6

Detergent Agglomerates made Using the Substrate According to Example 5

| | Amount |
|---|---|
| Ingredients dosed into a CB mixer | |
| Zeolite | 17.2% |
| Sodium carbonate powder | 12.1% |
| Substrate (A) from example 2, above | 45.2% |
| HLAS mix | 25.1% |
| $CO_2$ (loss on rxn) | −1.8% |
| Ingredients dosed into a KM 15000 agglomerator | |
| NaAS paste | 2.2% |
| Total | 100.0% |

Example 7

Granular Laundry Detergent Composition, Full Product Compositions Containing Agglomerates made with Substrate Powders The amounts of ingredients given below are in weight %.

| Ingredients | (A) | (B) | (C) | (D) | (E) |
|---|---|---|---|---|---|
| NaLAS active | 23.8% | 16.3% | 25.0% | 18.8% | 18.8% |
| NaAS active | 1.3% | 8.8% | 0.0% | 6.3% | 6.3% |
| Sodium Polyacrylate, MW 4500 | 10.0% | 10.0% | 12.0% | | |
| Sodium polyacrylate-polymaleic co-polymer, MW 12000 | | | | 10.0% | |
| Sodium polyacrylate-polymaleic co-polymer, MW 70000 | | | | | 8.0% |
| Sodium carbonate | 20.5% | 25.0% | 25.0% | 25.0% | 25.0% |
| Zeolite | 10.9% | 3.0% | 8.0% | 8.0% | 8.0% |
| Sodium sulfate | 15.2% | 17.0% | 15.0% | 15.0% | 15.0% |
| Others | 18.4% | 20.0% | 15.0% | 17.0% | 19.0% |
| Total | 100.0% | 100.0% | 100.0% | 100.0% | 100.0% |

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention. All documents cited herein are in relevant part, incorporated by reference. The citation of any document is not to be construed as an admission that it is prior art with respect to the present invention.

The invention claimed is:

1. A substrate composition comprising a spray dried composite composition comprising from 35 wt % to about 60 wt % of a water-soluble and/or water-dispersible polymer and from 20 wt % to about 80 wt % of a water-soluble inorganic salt, wherein the substrate composition has a median particle size of from about 1 micrometers to about 100 micrometers, and wherein the substrate composition comprises less than about 10 wt % of water-insoluble material, wherein the water-soluble and/or water-dispersible polymer is selected from the group consisting of polyacrylic acid polymer, polymaleic acid polymer, polyacrylic-maleic copolymer, salts thereof and mixtures thereof; and wherein the water soluble inorganic salt is selected from the group consisting of a carbonate, a silicate and mixtures thereof.

2. The substrate composition according to claim 1, wherein the substrate composition comprises from about 1 wt % to about 20 wt % of a first surfactant.

3. The substrate composition according to claim 1, wherein the sodium silicate has a molar ratio of $SiO_2$ to $Na_2O$ of from about 1.0 to about 3.2.

4. The substrate composition according to claim 1, wherein the substrate composition is substantially free from zeolite.

5. A substrate composition according to claim 1, wherein the substrate composition is in particulate form and comprises an outer surface, and wherein the concentration of the water-soluble and/or water-dispersible polymer in the outer surface is higher than the concentration of water-soluble and/or water-dispersible polymer in the remainder of the substrate composition.

6. The substrate composition of claim 1, wherein said spray dried composite composition is a dry granular powder.

7. The substrate composition of claim 6, wherein said dry granular powder comprises from about 3.9% to about 1.4% moisture.

8. The substrate composition of claim 1, wherein said spray dried composite composition consists essentially of from 35 wt % to about 60 wt % of a water-soluble and/or water-dispersible polymer, from 20 wt % to about 80 wt % of a water-soluble inorganic salt, and from about 1 wt % to about 20 wt % of a first surfactant.

9. A process for making the substrate composition according to claim 1, wherein the process comprises the steps of:

(1) mixing the water-soluble and/or water-dispersible polymer and the water-soluble inorganic salt to form a mixture that is in the form of a slurry;

(2) spray-drying the slurry mixture from step (1) to obtain a dry granular powder; and (3) milling the dry granular powder from step (2) to produce a substrate composition having a median particle size in the range from about 1 micrometer to about 50 micrometers.

10. A detergent composition comprising the substrate composition according to claim 1.

11. The detergent composition according to claim 9, wherein to detergent composition comprises a second surfactant.

12. A process for preparing the detergent composition according to claim 10, wherein the process comprises steps of:

(1) mixing the water-soluble and/or water-dispersible polymer and the water-soluble inorganic salt to form a mixture that is in the form of a slurry;

(2) spray-drying the slurry mixture from step (1) to obtain a dry granular powder;

(3) milling the dry granular power from step (2) to produce a substrate composition having a median particle size in the range from about 1 micrometer to about 50 micrometers; and (4) agglomerating the substrate composition from step (3) with a fluid binder to obtain a detergent granular composition.

* * * * *

UNITED STATES PATENT AND TRADEMARK OFFICE

CERTIFICATE OF CORRECTION

PATENT NO. : 7,459,422 B2
APPLICATION NO. : 11/201524
DATED : December 2, 2008
INVENTOR(S) : Paul R. Mort, III et al.

It is certified that error appears in the above-identified patent and that said Letters Patent is hereby corrected as shown below:

(1) Column 8, line 43, "Netsch CUM mill" should read --Netsch CUM-150 mill--
(2) Column 9, line 26, "(KM1500 Loedige)" should read --(KM15000 Loedige)--
(3) Column 9, line 49, "(KM1500 Loedige)" should read --(KM15000 Loedige)--
(4) Column 10, line 5, "(KM1500 Loedige)" should read --(KM15000 Loedige)--

Signed and Sealed this

Twenty-fourth Day of March, 2009

JOHN DOLL
*Acting Director of the United States Patent and Trademark Office*